US006988643B2

(12) United States Patent
Gouldson et al.

(10) Patent No.: US 6,988,643 B2
(45) Date of Patent: Jan. 24, 2006

(54) AUXILIARY BAR FOR A HANGER

(75) Inventors: Stanley F. Gouldson, Northport, NY (US); Olaf F. Olk, Hauppauge, NY (US)

(73) Assignee: Spotless Plastics Pty. Ltd., Moorabbin (AU)

( * ) Notice: Subject to any disclaimer, the term of this patent is extended or adjusted under 35 U.S.C. 154(b) by 138 days.

(21) Appl. No.: 10/188,269

(22) Filed: Jul. 2, 2002

(65) Prior Publication Data

US 2004/0004096 A1 Jan. 8, 2004

(51) Int. Cl.
*A41D 27/22* (2006.01)

(52) U.S. Cl. ..... 223/85

(58) Field of Classification Search ..... 223/85, 223/DIG. 4, 1, 93; 211/113; 248/340
See application file for complete search history.

(56) References Cited

U.S. PATENT DOCUMENTS

| | | | | |
|---|---|---|---|---|
| 989,448 | A | | 4/1911 | Traversi |
| 1,299,029 | A | | 4/1919 | Reed |
| 2,573,467 | A | | 10/1951 | Macaluso |
| 2,705,097 | A | | 3/1955 | Sherrard |
| 2,802,610 | A | | 8/1957 | De Lier |
| 2,883,095 | A | | 4/1959 | Greenbaum |
| 3,946,915 | A | | 3/1976 | Crane |
| 4,194,274 | A | | 3/1980 | Garrison |
| 4,446,996 | A | | 5/1984 | Garrison |
| 4,759,480 | A | * | 7/1988 | Duester et al. ..... 223/96 |
| 4,826,056 | A | | 5/1989 | Duester et al. |
| 4,884,727 | A | | 12/1989 | Blanchard |
| 4,901,894 | A | * | 2/1990 | Blanchard ..... 223/96 |
| 5,052,600 | A | | 10/1991 | Elchisak et al. |
| 5,082,153 | A | | 1/1992 | Duester et al. |
| 5,289,956 | A | | 3/1994 | Petrou |
| 5,400,932 | A | | 3/1995 | Hollis |
| 5,836,486 | A | * | 11/1998 | Ohsugi ..... 223/85 |
| 6,019,261 | A | | 2/2000 | Morgan et al. |
| 6,021,933 | A | | 2/2000 | Zuckerman |
| 6,202,906 | B1 | | 3/2001 | Zuckerman |

* cited by examiner

*Primary Examiner*—Gary L. Welch
(74) *Attorney, Agent, or Firm*—Scully, Scott, Murphy & Presser

(57) ABSTRACT

A hanger including; a hook; a support bar suspended from the hook, the support bar having an engagement surface; means for suspending a garment from the support bar; and an auxiliary bar having at least one clip portion having at least one clip for engaging the engagement surface of the hanger and a bottom rail supported from the clip over which a portion of the garment is draped.

31 Claims, 7 Drawing Sheets

AUXILIARY BAR FOR A HANGER

FIELD OF THE INVENTION

The present invention relates generally to hangers, and more particularly pertains to an auxiliary bar for a pinch grip hanger used for hanging pants and skirts for shipment to retailers and display of the same in a retail environment.

BACKGROUND OF THE INVENTION

Consumer taste and fashion have dictated a desire for mass-produced, but well-fitted garments, which are distributed and sold throughout the United States. Large national retailers of clothing generally contract with a plurality of clothing manufactured to produce uniform standardized clothing, which is essentially identical from batch to batch, even though manufacturers by different entities. These manufacturers in turn produce the clothing at their own plants, or in many cases, subcontract the production of the garments to manufacturers based in the Far East, for instance, in Hong Kong, Taiwan, Singapore and South Korea.

In the retail clothing industry clothing is typically suspended from hangers at the point of purchase. Such hangers are often inexpensive ship-on types and under prevailing garment-on-hanger programs, the garment is shipped from the manufacturer to the retailer while suspended from a hanger. Traditional garment-on-hanger pant and skirt hangers utilize spring clips that are manually pushed into a locking position to secure the pants or skirts to the hanger. In these hangers, referred to as "pinch grip hangers," a steel-retaining clip is manually clamped over a clamshell garment grip to secure the garment.

U.S. Pat. No. 4,759,480 to Duester et al. discloses a pinch grip hanger having an auxiliary bar. A portion of the garment, which is suspended from the pinch grips, is draped over the auxiliary bar. The auxiliary bar is typically fabricated from a metal wire and is pivotally disposed in the body of the hanger. However, the auxiliary bar can also be integrally formed with the body of the hanger. The draping of the garment over the auxiliary bar reduces the vertical space required to display a single garment, thus making the display of the garment compact and allowing display of a greater number of garments in the same display space.

Although, the auxiliary bars of the prior art have their advantages, they require specially manufactured garment hangers to either pivotally retain them therein or to be integrally molded therein. Therefore, pinch grip type hangers must be manufactured in both a version without an auxiliary bar and in a version with an auxiliary bar or capable of supporting an auxiliary bar.

SUMMARY OF THE INVENTION

Therefore, it is an object of the invention to provide an auxiliary bar for use with a pinch grip type hanger which does not require the pinch grip type hanger to be specially manufactured to retain the auxiliary bar thereon.

Accordingly, an auxiliary bar for use with a hanger is provided. The auxiliary bar comprises: at least one clip portion having at least one clip for engaging a surface of the hanger; and a bottom rail supported from the at least one clip over which a portion of a garment supported from the hanger is draped. Preferably, the at least one clip portion comprises first and second clip portions, each of which having at least one clip engaging a surface of the hanger.

The auxiliary bar preferably further comprises first and second side rails each having a first end connected to the first and second clip portions, respectively, and a second end connected to the bottom rail. Preferably, each of the first and second side rails have a vertical portion and a tapered portion, the vertical portion corresponding to the first end and the tapered portion corresponding to the second end and connected to the bottom rail. Where the hanger is a pinch grip hanger having first and second pinch grips offset from each other by a length, the tapered portion of each of the first and second side rails preferably terminate at each of a first and second end of the bottom rail, wherein a distance between the first and second ends of the bottom rail is greater than the length between the first and second pinch grips of the hanger. Preferably, a junction between the tapered portion and the bottom rail is radiused and at least the vertical portion has a low-profile cross-section. Where the hanger is a pinch grip hanger having at least one pinch grip for retaining a garment therein, the vertical portion preferably corresponds to the at least one pinch grip of the hanger. The tapered portion has a cross section having at least one side stiffening rib. Preferably, the at least one side stiffening rib comprises first and second side stiffening ribs disposed on a first and second edge of the tapered portion.

The bottom rail preferably also has a cross section having at least one bottom stiffening rib. Preferably, the at least one bottom stiffening rib comprises first and second bottom stiffening ribs disposed on a first and second edge of the bottom rail. One of the first and second bottom stiffening ribs preferably has a concave surface over which the portion of the garment is draped.

Preferably, the at least one clip comprises a first member depending from the clip portion and a second member depending from the first member, the first and second members defining a latch for engaging the surface of the hanger. The at least one clip preferably further comprises a one-way engagement means for lockingly engaging the surface of the hanger. Preferably, the one-way engagement means comprises a barb disposed at an end of the second member for lockingly engaging an edge of the surface of the hanger.

In an alternative version, the at least one clip comprises first and second opposing clips, each of the first and second opposing clips having a first member depending from the clip portion and a second member depending from the first member, the first and second members defining a channel for engaging the surface of the hanger. Preferably, each of the first and second clips further has a one-way engagement means for lockingly engaging the surface of the hanger. The one-way engagement means preferably comprises first and second barbs, one of which is disposed at an end of each of the second members for lockingly engaging first and second edges, respectively, of the surface of the hanger.

Also provided is a hanger. The hanger comprising; a hook; a support bar suspended from the hook, the support bar having an engagement surface; means for suspending a garment from the support bar; and an auxiliary bar having at least one clip portion having at least one clip for engaging the engagement surface of the hanger and a bottom rail supported from the clip over which a portion of the garment is draped.

Preferably, the at least one clip portion comprises first and second clip portions, each of which having at least one clip engaging an engagement surface of the hanger. The pinch grip hanger preferably further comprises first and second side rails each having a first end connected to the first and second clip portions, respectively, and a second end connected to the bottom rail. Each of the first and second side rails preferably have a vertical portion and a tapered portion, the vertical portion corresponding to the first end and the tapered portion corresponding to the second end and connected to the bottom rail.

Where the means for supporting the garment comprises first and second pinch grips mounted on the support bar at first and second ends thereof for insertion or release of a garment therein and where the first and second pinch grips are offset from each other by a length, the tapered portion of each of the first and second side rails preferably terminate at each of a first and second ends of the bottom rail, wherein a distance between the first and second ends of the bottom rail is greater than the length between the first and second pinch grips.

Preferably, a junction between the tapered portion and the bottom rail is radiused and at least the vertical portion has a low-profile cross-section. Where the means for supporting the garment comprises at least one pinch grip mounted on the support bar for insertion or release of a garment therein, the vertical portion preferably corresponds to the at least one pinch grip and the vertical portion is disposed in a channel formed in at least a portion of the at least one pinch grip.

Preferably, the tapered portion has a cross section having at least one side stiffening rib. The at least one side stiffening rib preferably comprises first and second side stiffening ribs disposed on a first and second edge of the tapered portion. The bottom rail preferably has a cross section having at least one bottom stiffening rib. Preferably, the at least one bottom stiffening rib comprises first and second bottom stiffening ribs disposed on a first and second edge of the bottom rail. More preferably, one of the first and second bottom stiffening ribs has a concave surface over which the portion of the garment is draped.

The at least one clip preferably comprises a first member depending from the clip portion and a second member depending from the first member, the first and second members defining a latch for engaging the engagement surface. Preferably, the clip further comprises a one-way engagement means for lockingly engaging the engagement surface. The one-way engagement means preferably comprises a barb disposed at an end of the second member for lockingly engaging an edge of the engagement surface.

The at least one clip preferably comprises first and second opposing clips, each of the first and second opposing clips having a first member depending from the clip portion and a second member depending from the first member, the first and second members defining a channel for engaging the surface of the hanger. Preferably, each of the first and second clips further has a one-way engagement means for lockingly engaging the surface of the hanger. The one-way engagement means preferably comprises first and second barbs, one of which is disposed at an end of each of the second members for lockingly engaging first and second edges, respectively, of the surface of the hanger.

BRIEF DESCRIPTION OF THE DRAWINGS

These and other features, aspects, and advantages of the apparatus of the present invention will become better understood with regard to the following description, appended claims, and accompanying drawings where:

DETAILED DESCRIPTION OF THE PRESENT INVENTION

Although this invention is applicable to numerous and various types of hangers, it has been found particularly useful in the environment of grip and pinch grip type hangers. Therefore, without limiting the applicability of the invention to grip and pinch grip type hangers, the invention will be described in such environment.

Figure 1:
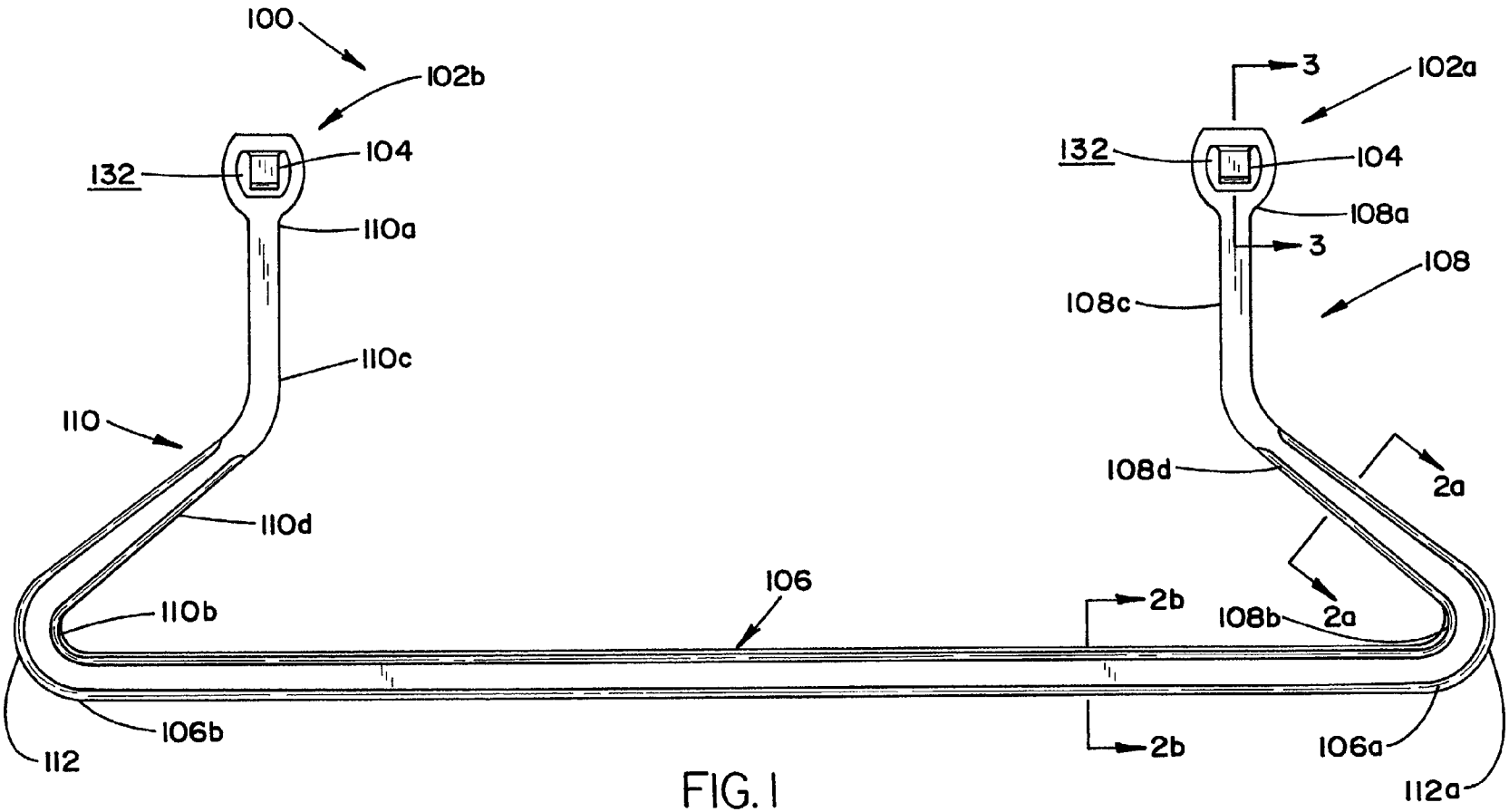
FIG. 1 illustrates a front view of an auxiliary bar according to a preferred implementation of the present invention.

Referring now to FIG. 1, there is shown an auxiliary bar for use with a hanger, the auxiliary bar being referred to generally by reference numeral 100. The auxiliary bar has at least one clip portion 102, and preferably two clip portions 102*a*, 102*b* offset from each other. Each clip portion 102*a*, 102*b* has a clip 104, which as will be described below, engages a surface of a hanger to suspend the auxiliary bar 100 from the hanger.

The auxiliary bar 100 has a bottom rail 106 supported from the clips 104 over which a portion of a garment supported from the hanger is draped. First and second side rails 108, 110 depend from the clip portions 102 and each have a first end 108*a*, 110*a* connected to their respective clip portions 102*a*, 102*b* and a second end 108*b*, 110*b* connected to the bottom rail 106. Preferably, each of the first and second side rails 108, 110 have a vertical portion 108*c*, 110*c* and a tapered portion 108*d*, 110*d*. The vertical portions 108*c*, 110*c* correspond to the first end 108*a*, 110*a* and the tapered portions 108*d*, 110*d* correspond to the second end 108*b*, 110*b*.

Preferably, the tapered portions 108*d*, 110*d* taper outwardly to connect to first and second ends 106*a*, 106*b* of the bottom rail 106 such that the length of the bottom rail 106 is greater than the distance between the clip portions 102*a*, 102*b*. A junction 112*a*, 112*b* between each of the tapered portions 108*d*, 110*d* and the first and second ends 106*a*, 106*b* of the bottom rail 106 is preferably radiused.

Preferably, for reasons that will be discussed below and apparent to those skilled in the art, at least the vertical portion 108*c*, 110*c* of the side rails 108, 110 have a low-profile cross-section. Preferably, the low profile cross-section of the vertical portion 108*c*, 110*c* is a flat rectangular shape, as seen more clearly in the sectional view of FIG. 7.

Figure 2B:
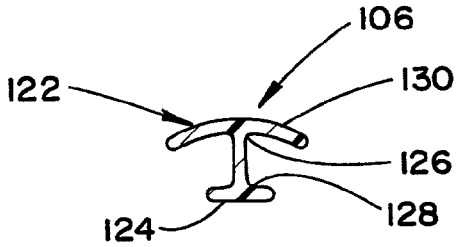
FIGS. 2*a* and 2*b* illustrate a sectional view of the tapered portion of the side rail and the bottom rail, respectively, of the auxiliary bar of FIG. 1 as taken along lines 2*a*—2*a* and 2*b*—2*b*, respectively.
Figure 2A:
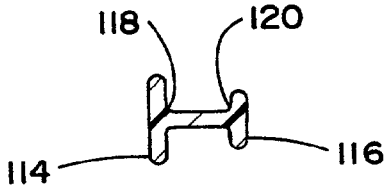

Referring now to FIG. 2*a*, the tapered portions 108*d*, 110*d* of the side rails 108, 110 preferably have a cross section having at least one side stiffening rib. More preferably, the cross section of the tapered portions 108*d*, 110*d* have first and second side stiffening ribs 114, 116 disposed on a first and second edge 118, 120 of the tapered portion 108*d*. The stiffening ribs 114, 116 can be the same size, or as shown in FIG. 2*a*, the first stiffening rib 114, which is positioned on the first or inner edge 118 of the tapered portion 108*d*, is preferred to be larger to provide added rigidity without adding additional material and bulk. Although, only one of the tapered portions 108*d* is described as having the stiffening ribs 114, 116, it will be appreciated by those in the art that each of the tapered portions 108*d*, 110*d* is so configured.

Referring now to FIG. 2*b*, the bottom rail 106 also preferably has a cross section having at least one bottom stiffening rib. Similarly to the tapered portions 108*d*, 110*d* of the side rails 102*a*, 102*b*, the bottom rail 106 preferably includes first and second bottom stiffening ribs 122, 124 disposed on a first and second edge 126, 128 of the bottom rail 106. As discussed above with regard to the stiffening ribs 114, 116 of the tapered portion 108*d* of the side rail 102*a*, it is preferred that one of the bottom stiffening ribs 122 be larger than the other stiffening rib 124. Furthermore, it is more preferred that the inner of the stiffening ribs (122 in the configuration shown in FIGS. 1 and 2*b*) have a concave surface 130 over which the portion of the garment is draped.

Figure 3:
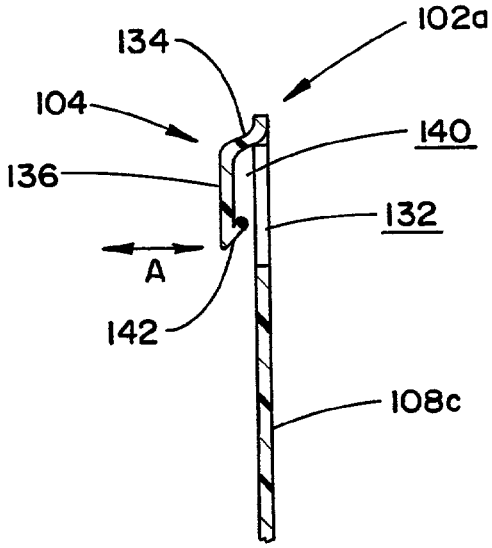
FIG. 3 illustrates a sectional view of the clip portion of the auxiliary bar of FIG. 1 as taken along line 3—3 therein.

Referring now to FIGS. 1 and 3 in combination, the clip 104 comprises a hole 132 formed in the clip portion 102*a* and a first member 134 depending from the clip portion 102*a* and preferably from an edge of the hole 132. A second member 136 depends from the first member 134, preferably, in an orthogonal manner. The first and second members 134, 136 define a U-shaped cavity 140 for engaging a surface of the hanger. The clip further preferably comprises a one-way engagement means for lockingly engaging the clip 104 to a surface of the hanger. The one-way engagement means preferably comprises a barb 142 disposed at an end of the second member 136 for lockingly engaging an edge of a surface of the hanger. Those skilled it the art will appreciate that the clip is capable of elastic deformation in the direction of Arrow A, which as will be described below, facilitates the engagement of the clip 104 with a surface of a hanger and the locking of the clip 104 thereon. Although, only one of the clip portions 102*a* is described and illustrated in FIG. 3, it will be appreciated by those in the art that each of the clip portions 102*a*, 102*b* is so configured.

Figure 4:
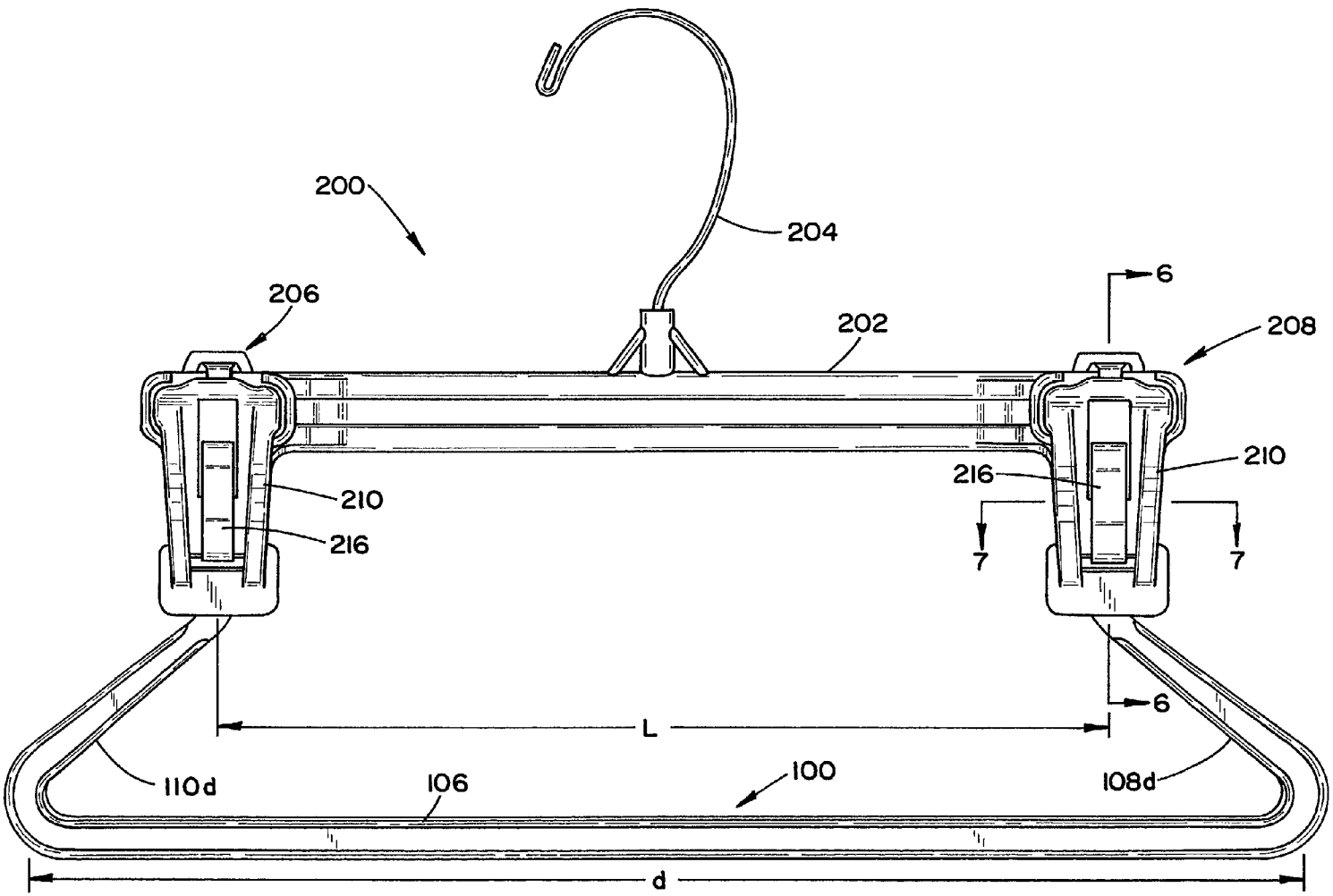
FIG. 4 illustrates a front view of a pinch grip hanger having the auxiliary bar of FIG. 1 disposed thereon.
Figure 5:
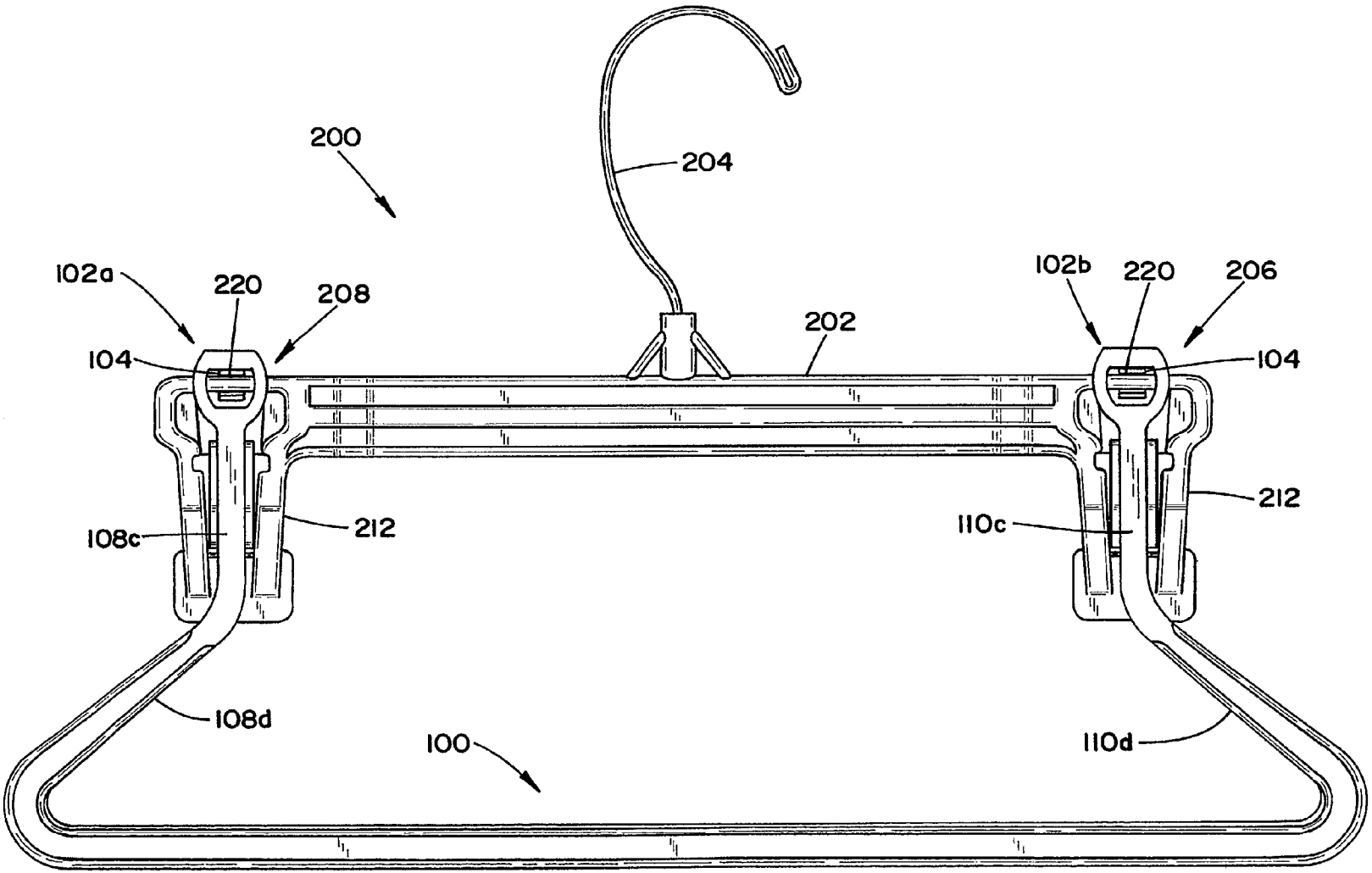
FIG. 5 illustrates a rear view of the pinch grip hanger and auxiliary bar of FIG. 4.

Referring now to FIGS. 4 and 5, there is illustrated a pinch grip hanger 200 having the preferred implementation of the auxiliary bar 100 of the present invention disposed thereon. FIG. 4 being a plan view of the front side of the hanger 200 and auxiliary bar 100 and FIG. 5 being the reverse side. The pinch grip hanger 200 is molded of plastic with a support bar 202 and an upwardly extended hook member 204. As illustrated in FIGS. 4 and 5, the hook member 204 is separately fabricated, typically from metal, and rotatably disposed in the support bar 202. However, those skilled in the art will appreciate that the hook member 204 may also be formed of plastic and integrally molded with the support bar 202. Although, not shown, the hanger 200 may also be fitted with a pivoting flange to receive a side sizer in the matter taught in U.S. Pat. No. 6,260,745, also assigned to the assignee of the present invention.

Figure 6:
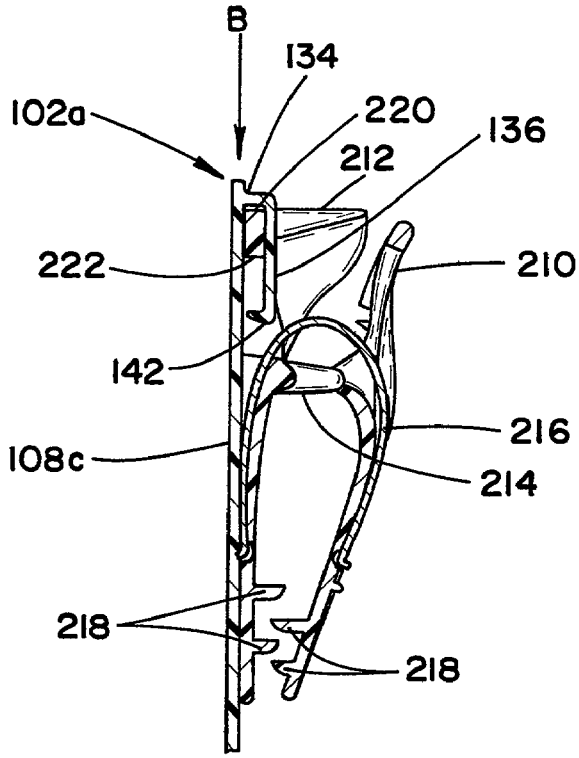
FIG. 6 illustrates a partial vertical sectional view of the pinch grip of the hanger and auxiliary bar of FIG. 4 as taken along line 6—6 therein.

As illustrated in FIGS. 4 and 5, the pinch grip hanger 200 includes a first 206 and second 208 pinch grip positioned on either end of the support bar 202. Each of the pinch grips 206 and 208 include first and second pinch grip jaws 210, 212 (shown in cross-section in FIG. 6) with the second jaw members 212 being integrally molded with the support bar 202. The first jaw members 210 are pivotally secured to the second jaw members 212 at a pivot mounting 214, by a spring member 216, which is typically a metal clip which biases the first and second jaw members 210, 212 into a closed position (as shown in FIG. 6). Each of the first and second jaws 210, 212 may be fitted with a molded non-slip pad (not shown) or maybe molded with teeth 218, as more fully illustrated in FIG. 6.

Figure 7:
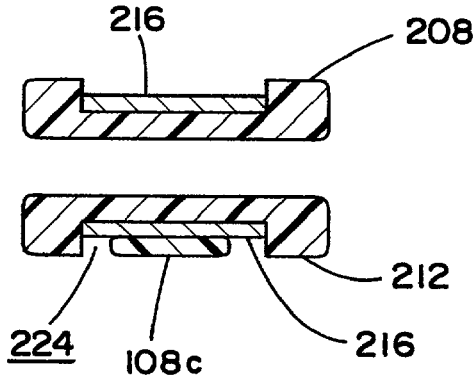
FIG. 7 illustrates a horizontal sectional view of the pinch grip of the hanger and auxiliary bar of FIG. 4 as taken along line 7—7 therein.

Referring now to FIGS. 6 and 7 in combination with FIG. 5, the clips 104 of the auxiliary bar 100 engage an engagement surface 220 of the hanger 200. Specifically, the U-shaped cavity 140 is shaped and sized to accept the engagement surface 220 therein. The barb 142 lockingly engages an edge 222 of the engagement surface 220 to lock the clip 104 on the engagement surface 220. When the clip 104 is pushed in the direction of Arrow B the barb 142 is forced outward in the direction of Arrow C. Since the auxiliary bar 100 is fabricated from a resilient material capable of plastic deformation, the first and/or second members 134, 136 plastically deform until the barb 142 passes the edge 222 at which point the barb 142 and the first and/or second members 134, 136 deform back to the shape illustrated in FIG. 6. To remove the clip 104 from the engagement surface 220, the barb is pushed, preferably manually with a tool in the direction of Arrow C and the clip is removed in a direction opposite to the direction of Arrow B. Preferably, the material of the auxiliary bar 100 is such that it is capable of the plastic deformation discussed above yet have a low degree of brittleness to prevent stress fractures of the clip 104 due to repeated usage. Preferably, the material is a thermoplastic, such as polystyrene or blends thereof.

Referring now to FIGS. 6 and 7 in combination, the engagement surface 220 is preferably proximate each of the pinch grips 206, 208 with the vertical portion 108*c*, 110*c* disposed in a channel 224 formed in at least a portion of the pinch grips 206, 208. Since, the vertical portion 108*c*, 110*c* of the side rails 108, 110 preferably has a low-profile cross section, as discussed above, the same can be disposed in a relatively shallow channel 224. Therefore, the addition of the auxiliary bar 100 to the pinch grip hanger 200 results in no or no appreciable increase in thickness as compared to the pinch grip hanger 200 alone.

Referring back to FIG. 4, as also discussed above, the first and second pinch grips 206, 208 are offset from each other by a length l and due to the outwardly tapered portions 108*d*, 110*d* of each of the side rails 108, 110, a distance d between the first and second ends 106*a*, 106*b* of the bottom rail 106 is greater than the length l between the first and second pinch grips 206, 208. Those skilled in the art will appreciate that the greater length l facilitates easy draping of the garment over the bottom rail 106 without crimping and wrinkling of the garment.

Figure 8:
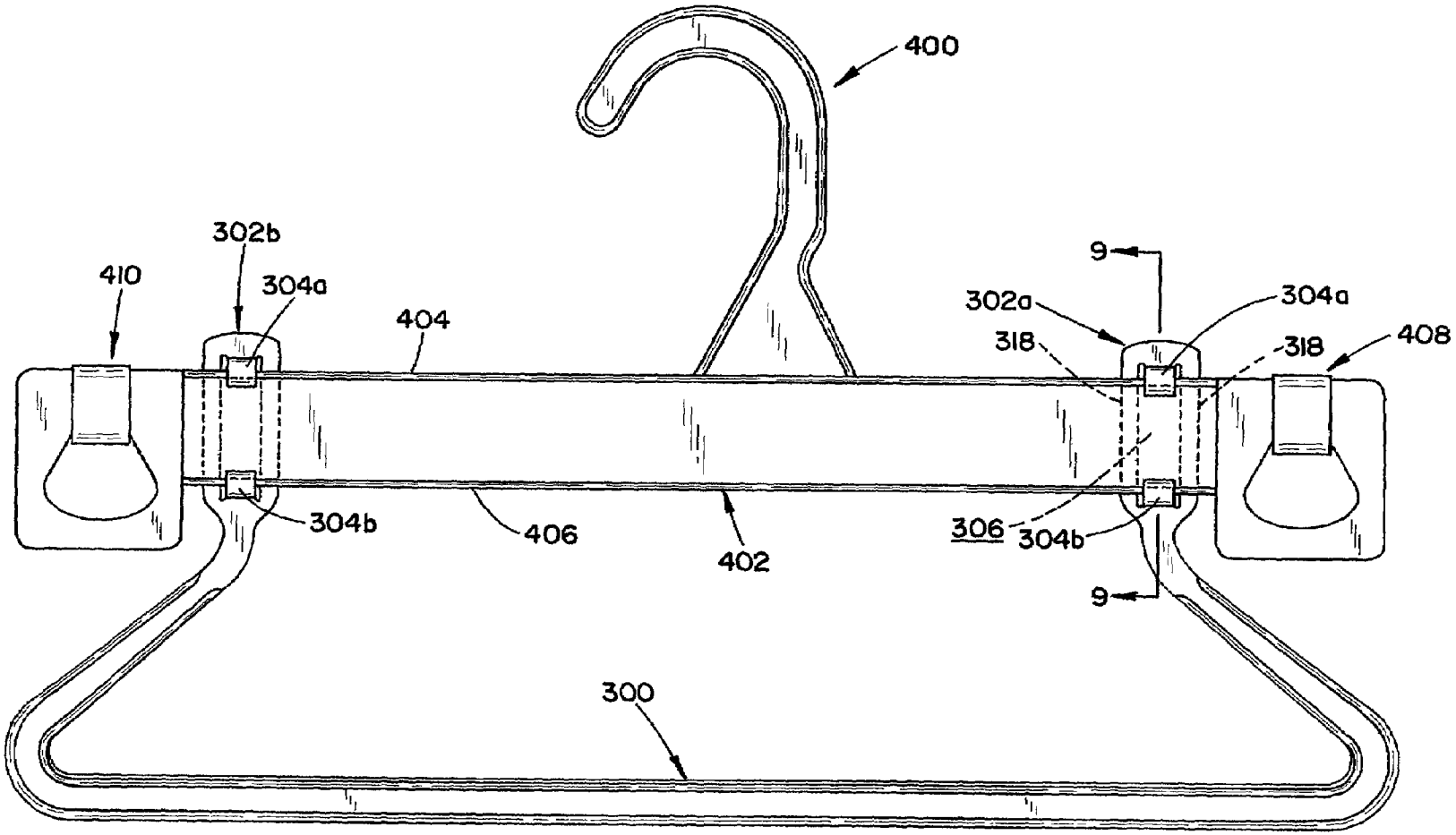
FIG. 8 illustrates a front view of a grip hanger having an alternative version of an auxiliary bar disposed thereon.
Figure 9:
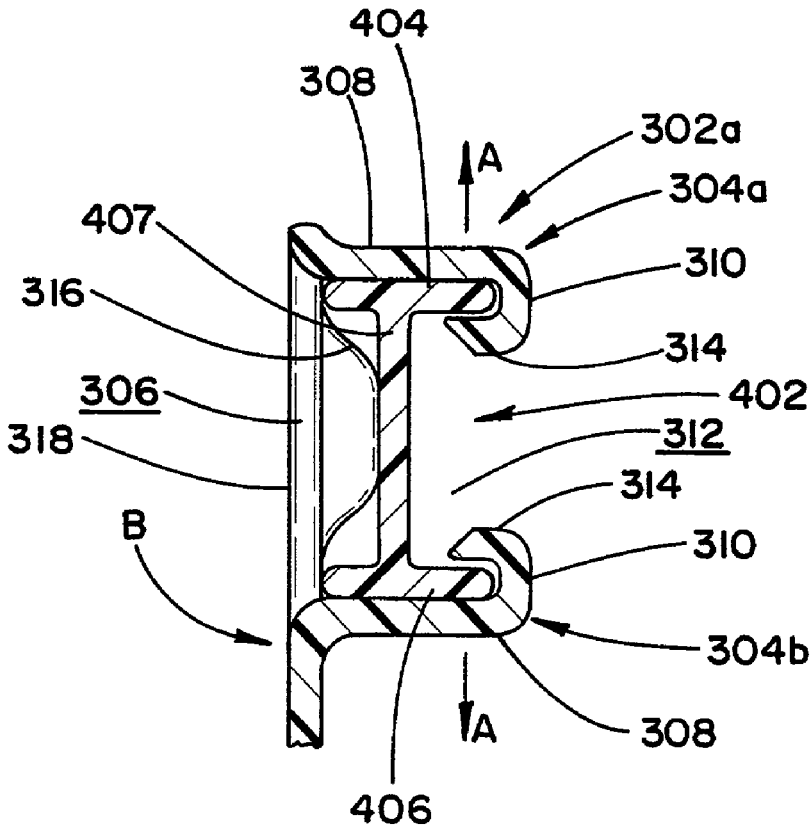
FIG. 9 illustrates a sectional view of the grip hanger and auxiliary bar of FIG. 8 as taken along line 9—9 therein.

Referring now to FIGS. 8 and 9, there is shown an alternative version of the auxiliary bar of the present invention, shown by way of example disposed on a grip hanger. The auxiliary bar and grip hanger being referred to generally by reference numerals 300 and 400, respectively. The auxiliary bar 300 is substantially similar to the auxiliary bar 100 described previously, with the exception of the clip portions, referred to by reference numerals 302*a* and 302*b*.

Clip portions 302*a*, 302*b* each comprise first and second opposing clips 304*a*, 304*b* and a hole 306 formed in the clip portion 302*a*. Each of the first and second clip portions 304*a*, 304*b* have a first member 308 depending from the clip portion 302*a* and preferably from an edge of the hole 306 and a second member 310 depending from the first member 308, preferably, in an orthogonal manner and in an opposing manner such that the second members 310 extend towards each other. The first and second members 308, 310 define a channel 312 for engaging a surface of the hanger 400. The first and second opposing clips 304*a*, 304*b* further preferably comprise a one-way engagement means for lockingly engaging the clips 304*a*, 304*b* to a surface of the hanger 400. The one-way engagement means preferably comprises a barb 314 disposed at an end of each of the second members 310 for lockingly engaging a surface of the hanger 400. Those skilled it the art will appreciate that the clip is capable of elastic deformation in the direction of Arrow A, which as will be described below, facilitates the engagement of the opposing clips 304*a*, 304*b* with the hanger 400 and the locking of the opposing clips 304*a*, 304*b* thereon. Although, only one of the clip portions 302*a* is described and illustrated in FIG. 9, it will be appreciated by those in the art that each of the clip portions 302*a*, 302*b* is so configured.

The hanger 400 has a horizontal bar 402 having first and second ribs 404, 406 disposed at first and second ends of a connecting member 407. The horizontal bar 402 terminates at both ends with grips 408, 410. The opposing clips 304*a*, 304*b* of the auxiliary bar 300 preferably engage the horizontal bar 402 of the hanger 200 inside the grips 408, 401. Specifically, the channel 312 is shaped and sized to accept the cross-sectional shape of the horizontal bar 402 therein. Each barb 314 lockingly engages one of the first and second ribs 404, 406 of the horizontal bar 402 to lock the clips 304*a*, 304*b* on the horizontal bar 402. The engagement of the clip portions 302*a*, 302*b* with the horizontal bar 402 is similar to that previously described with regard to FIG. 6. However, since two opposing clips 304*a*, 304*b* are utilized, one of the clips, preferably the first clip 304*a*, is hooked on to the first rib 404 and the second clip 304 is rotated towards the second rib 406 in direction B. Since the auxiliary bar 300 is fabricated from a resilient material capable of plastic deformation, the first and/or second members 308, 310 plastically deform until the barb 314 passes the second rib 406 at which point the barb 314 and the first and/or second members 308, 310 deform back to the shape illustrated in FIG. 9. The clips 304*a*, 304*b* are removed by plastically deforming the first and/or second members 308, 310 until the barb 314 clears its corresponding rib 404, 406. Preferably, the auxiliary bar 300 further has a support member 316, which engages a surface of the connecting member 407 to provide an additional support against the horizontal bar 402. Preferably, the support member is integrally formed with either or both of side members 318 that define a portion of the hole 306.

Several embodiments and variations of the present invention for the auxiliary bar and pinch grip hanger for use therewith are described in detail herein. However, it should be apparent that the disclosure and teachings of the present invention will suggest many alternative designs to those skilled in the art.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

We claim:

1. An auxiliary bar for use with a hanger, the auxiliary bar comprising:

first and second clip portions each having at least one clip comprising a one-way engagement means for lockingly engaging a surface of the hanger;

a bottom rail supported from the at least one clip over which a portion of a garment supported from the hanger is draped; and first and second side rails each having a first end connected to the first and second clip portions, respectively, and each having a second end connected to the bottom rail, each of the first and second side rails having a vertical portion and a tapered portion, the vertical portion corresponding to the first end and the tapered portion corresponding to the second end and connected to the bottom rail, the tapered portion having a cross section having at least one side stiffening rib.

2. The auxiliary bar of claim 1, wherein the hanger is a pinch grip hanger having first and second pinch grips offset from each other by a length, the tapered portion of each of the first and second side rails terminating at each of a first and second end of the bottom rail, wherein a distance between the first and second ends of the bottom rail is greater than the length between the first and second pinch grips of the hanger.

3. The auxiliary bar of claim 1, wherein a junction between the tapered portion and the bottom rail is radiused.

4. The auxiliary bar of claim 1, wherein at least the vertical portion has a low-profile cross-section.

5. The auxiliary bar of claim 4, wherein the hanger is a pinch grip hanger having at least one pinch grip for retaining a garment therein and wherein the vertical portion corresponds to the at least one pinch grip of the hanger.

6. The auxiliary bar of claim 1, wherein the at least one side stiffening rib comprises first and second side stiffening ribs disposed on a first and second edge of the tapered portion.

7. The auxiliary bar of claim 1, wherein the bottom rail has a cross section having at least one bottom stiffening rib.

8. The auxiliary bar of claim 7, wherein the at least one bottom stiffening rib comprises first and second bottom stiffening ribs disposed on a first and second edge of the bottom rail.

9. The auxiliary bar of claim 8, wherein one of the first and second bottom stiffening ribs has a concave surface over which the portion of the garment is draped.

10. The auxiliary bar of claim 1, wherein the at least one clip comprises a first member depending from the clip portion and a second member depending from the first member, the first and second members defining a u-shaped cavity for engaging the surface of the hanger.

11. The auxiliary bar of claim 10, wherein the one-way engagement means comprises a barb disposed at an end of the second member for lockingly engaging an edge of the surface of the hanger.

12. The auxiliary bar of claim 1, wherein the at least one clip comprises first and second opposing clips, each of the first and second opposing clips having a first member depending from the clip portion and a second member depending from the first member, the first and second members defining a channel for engaging the surface of the hanger.

13. The auxiliary bar of claim 12, wherein each of the first and second clips comprises a one-way engagement means for lockingly engaging the surface of the hanger.

14. The auxiliary bar of claim 13, wherein the one-way engagement means comprises first and second barbs, one of which is disposed at an end of each of the second members for lockingly engaging first and second edges, respectively, of the surface of the hanger.

15. A hanger comprising;

a hook;

a support bar suspended from the hook;

a means positioned on the support bar for suspending a garment;

an auxiliary bar comprising first and second clip portions, each having at least one clip for engaging the support bar of the hanger; said clip comprising a one-way engagement means for lockingly engaging a surface of the hanger; said auxiliary bar further comprising a bottom rail supported from the at least one clip over which a portion of the garment is draped; and first and second side rails each having a first end connected to the first and second clip portions, respectively, and each having a second end connected to the bottom rail, each of the first and second side rails having a vertical portion and a tapered portion, the vertical portion corresponding to the first end and the tapered portion corresponding to the second end and connected to the bottom rail, the tapered portion having a cross section having at least one side stiffening rib.

16. The pinch grip hanger of claim 15, wherein the means for suspending the garment comprises first and second pinch grips mounted on the support bar at first and second ends thereof for insertion or release of a garment therein, wherein the first and second pinch grips are offset from each other by a length, the tapered portion of each of the first and second side rails terminating at each of first and second ends of the bottom rail, wherein a distance between the first and second ends of the bottom rail is greater than the length between the first and second pinch grips.

17. The pinch grip hanger of claim 15, wherein a junction between the tapered portion and the bottom rail is radiused.

18. The pinch grip hanger of claim 15, wherein at least the vertical portion has a low-profile cross-section.

19. The pinch grip hanger of claim 18, wherein the means for suspending the garment comprises at least one pinch grip mounted on the support bar for insertion or release of a garment therein, wherein the vertical portion corresponds to the at least one pinch grip.

20. The pinch grip hanger of claim 19, wherein the vertical portion is disposed in a channel formed in at least a portion of the at least one pinch grip.

21. The pinch grip hanger of claim 15, wherein the at least one side stiffening rib comprises first and second side stiffening ribs disposed on a first and second edge of the tapered portion.

22. The pinch grip hanger of claim 15, wherein the bottom rail has a cross section having at least one bottom stiffening rib.

23. The pinch grip hanger of claim 22, wherein the at least one bottom stiffening rib comprises first and second bottom stiffening ribs disposed on a first and second edge of the bottom rail.

24. The pinch grip hanger of claim 23, wherein one of the first and second bottom stiffening ribs has a concave surface over which the portion of the garment is draped.

25. The pinch grip hanger of claim 15, wherein the at least one clip comprises a first member depending from the clip portion and a second member depending from the first member, the first and second members defining a u-shaped cavity for engaging the support bar.

26. The pinch grip hanger of claim 25, wherein the one-way engagement means comprises a barb disposed at an end of the second member for lockingly engaging an edge of the support bar.

27. The pinch grip hanger of claim 15, wherein the at least one clip comprises first and second opposing clips, each of the first and second opposing clips having a first member depending from the clip portion and a second member depending from the first member, the first and second members defining a channel for engaging the support bar of the hanger.

28. The pinch grip hanger of claim 27, wherein each of the first and second clips comprises a one-way engagement means for lockingly engaging the support bar of the hanger.

29. The pinch grip hanger of claim 28, wherein the one-way engagement means comprises first and second barbs, one of which is disposed at an end of each of the second members for lockingly engaging first and second edges, respectively, of the support bar of the hanger.

30. An auxiliary bar for use with a hanger, the auxiliary bar comprising:

first and second clip portions each having at least one clip for engaging a surface of the hanger, a bottom rail supported from the at least one clip over which a portion of a garment supported from the hanger is draped; and first and second side rails each having a first end connected to the first and second clip portions, respectively, and each having a second end connected to the bottom rail, each of the first and second side rails having a vertical portion and a tapered portion, the vertical portion corresponding to the first end and the tapered portion corresponding to the second end and connected to the bottom rail, the tapered portion having a cross section having at least one side stiffening rib;

wherein the first and second clip portions each comprises a first member depending from the clip portion and a second member depending from the first member, the first and second members defining a u-shaped cavity for engaging the surface of the hanger.

31. A hanger comprising;

a hook;

a support bar suspended from the hook;

a means positioned on the support bar for suspending a garment; and an auxiliary bar comprising first and second clip portions each having at least one clip for engaging the support bar of the hanger; said auxiliary bar further comprising a bottom rail supported from the at least one clip over which a portion of the garment is draped; and first and second side rails each having a first end connected to the first and second clip portions, respectively, and each having a second end connected to the bottom rail, each of the first and second side rails having a vertical portion and a tapered portion, the vertical portion corresponding to the first end and the tapered portion corresponding to the second end and connected to the bottom rail, the tapered portion having a cross section having at least one side stiffening rib:

wherein the first and second clip portions each comprises a first member depending from the clip portion and a second member depending from the first member, the first and second members defining a u-shaped cavity for engaging the support bar.

* * * * *